United States Patent [19]

DuBois

[11] 4,135,117

[45] Jan. 16, 1979

[54] VACUUM FLUORESCENT DEVICE WITH CONTINUOUS STROKES

[75] Inventor: Richard DuBois, North Caldwell, N.J.

[73] Assignee: Wagner Electric Corporation, Parsippany, N.J.

[21] Appl. No.: 887,865

[22] Filed: Mar. 20, 1978

[51] Int. Cl.[2] ..... H05B 37/00; H05B 39/00; H05B 41/00

[52] U.S. Cl. ..... 340/758; 313/496; 315/169.1

[58] Field of Search ..... 313/495, 496, 497, 510; 215/169 R, 169 TV

[56] References Cited

U.S. PATENT DOCUMENTS

| | | | |
|---|---|---|---|
| 3,201,634 | 8/1965 | Weidel et al. | 313/497 |
| 4,047,072 | 9/1977 | Kishino et al. | 313/496 |

OTHER PUBLICATIONS

"Multi-digit Fluorescent Indicator Tubes", Toshiba Review, No. 101, Jan.-Feb. 1976, pp. 31-36.

*Primary Examiner*—Alfred E. Smith
*Assistant Examiner*—Robert E. Wise
*Attorney, Agent, or Firm*—Eyre, Mann, Lucas & Just

[57] ABSTRACT

The inter-anode gaps in a vacuum fluorescent display device are coated with phosphor and the electronic driving circuitry permits gaps which are bounded by energized anodes to be illuminated.

22 Claims, 9 Drawing Figures

VACUUM FLUORESCENT DEVICE WITH CONTINUOUS STROKES

BACKGROUND OF THE INVENTION

The present invention relates to fluorescent display devices and in particular to fluorescent display devices in which phosphor material such as ZnO:Zn or the like, coated on conductive elements is selectively made to fluoresce by selective energization or deenergization of the conductive elements.

There are two broad classifications of fluorescent display devices namely (a) gas discharge and (b) vacuum fluorescent. In a gas discharge device, an electric field is set up between phosphor coated shaped cathode segments and one or more anodes in an atmosphere of easily ionizable gas such as neon. The shaped cathode segments may form characters on which the phosphor coating is selectively illuminated by applying voltages to selected ones of the segments. A typical construction of a gas discharge device is shown in U.S. Pat. No. 3,902,003.

In a vacuum fluorescent device, an electron emitter, such as a thermionic or field emitter, supplies electrons through a vacuum to phosphor coated shaped anode segments. The shaped anode segments may be selectively illuminated in a manner similar to the cathode segments by selectively applying voltages thereto, although the polarities and magnitudes of the voltages will differ between devices. A typical construction of a vacuum fluorescent display device is shown in U.S. Pat. No. 3,986,760.

Additional electrodes may be used in either type of device for simultaneously controlling groups of segments, shielding against external electric fields or cancelling the effect of charge buildup on dielectric materials of the devices.

Modern fluorescent display devices employ a generally planar insulating substrate having the conductive shaped anode or cathode segments formed on the planar surface or slightly recessed therein. Typically a plurality of changeable characters, such as 7-segment numeric patterns, are disposed on the substrate. A concave cover plate, usually of glass, is sealed at its perimeter to the substrate to form a sealed enclosure enclosing the anode or cathode segments as well as additional electrodes. The atmosphere in the sealed enclosure is evacuated or replaced with gas as required by the particular type of display device.

The energization of the segments is normally controlled by the electronic equivalent of a single-pole single-throw switch. That is, each switch either connects an energizing voltage to its associated segment or disconnects the segment thus allowing it to float.

The anode or cathode segments are usually applied to the substrate by silk screen printing, lithography or by chemical etching of a continuous conductive coating or by other methods well known in the art. Adjacent segments are usually separated by a gap of, for example, 15–20 thousandths of an inch to avoid inter-segment short circuits. The phosphor material, typically zinc activated zinc oxide, ZnO:Zn, europeum activated tin oxide, SnO:Eu, or other phosphor known in the art, is applied through a mask in order to separately cover the segments without coating the substrate between segments. Care is necessary to avoid coating the substrate between segments because the ZnO:Zn, although a poorly conducting material, is a sufficiently good conductor to provide a conductive bridge between adjacent segments. This conductive bridge is sufficiently conductive to illuminate a floating unenergized segment adjacent to an energized segment. Thus the gaps in phosphor are essential for selective illumination of the segments.

Unfortunately, the necessity for gaps between adjacent segments also results in a discontinuity in the illuminated line when adjacent segments are energized. This discontinuity interferes with accurate representation of alphanumeric characters. In addition, the care required in accurately coating the segments to avoid forming the conductive bridges increases manufacturing cost.

SUMMARY OF THE INVENTION

The applicant has discovered that conductive segmented electrodes can be coated with poorly conducting phosphor in a continuous link without forming gaps in the phosphor between adjacent segments. The phosphor line is coated on the substrate in the gap between segments.

The present invention does not depend on the choice of a particular phosphor. Any suitable phosphor known in the art may be used.

The conductive segmented electrodes may be of any material known in the art suitable for inclusion in a fluorescent display device. For example, metals such as aluminum, copper, gold, platinum or other pure or alloyed metals may be employed. In addition, compounds including metals such as iron oxide, tin oxide, or other relatively conductive material may be used. The conductive segmented electrodes need not have the conductivity of metals. For example, finely divided carbon may be coated on the substrate or upon a metallic segment and the phosphor may be coated upon the carbon. The important relationship is the relative conductivity of the segmented electrode compared to the phosphor. The surface resistivity of the phosphor should be at least ten times as great as the surface resistivity of the conductive segmented electrodes measured in ohms per square. For best results, the surface resistivity of the phosphor should be at least 100 times the surface resistivity of the conductive segmented electrodes.

Any type of phosphor which is compatable with the internal environment of the fluorescent display device including the material from which the conductive segmented electrodes are formed is satisfactory for use in this invention. Numerous oxides and sulfides and other compounds of metals such as berylium, barium, cadmium, calcium, tin and zinc are suitable. U.S. Pat. Nos. 2,451,590 and 3,967,125 herein incorporated by reference, describe the compositions of these materials as well as numerous others which are satisfactory in the present application. For best results, ZnO:Zn or SnO:Eu should be used. Other phosphors from the references will yield different colors, brightnesses, tolerance of temperature and voltage variations and other parameters. However, one skilled in the art, given the teaching of this specification would readily select a phosphor and conductive electrode for his application without requiring any experimentation.

Electrical control of each segment is controlled by the equivalent of a single-pole double-throw switch. In one condition of the switch, an energizing voltage is connected to its segment causing the phosphor on the segment to glow. In the other condition of the switch, a deenergizing voltage is connected to its segment, causing its phosphor to extinguish. When adjacent segments are both energized, the phosphor in the gap between segments is illuminated along with the phosphor on the energized segments. This provides a continuous illuminated line. When one segment is energized and an adjacent segment is deenergized, the phosphor on the deenergized segment remains extinguished because it is being maintained at a deenergizing voltage. The phosphor bridging the gap between the energized and deenergized segments has a voltage along it which varies from the energizing voltage at the edge of the energized segment to the deenergizing voltage at the edge of the deenergized segment. The phosphor in the gap is illuminated part way across the gap from the energized segment until the voltage is no longer sufficient to maintain fluorescence.

Besides the relationship between the surface resistivities of the phosphor and the conductive electrodes, the resistivity of the phosphor is limited by the effect of resistance heating on the phosphor in the gap. In the case of ZnO:Zn, it is known that at a temperature above 350° C. the phosphor fluoresces due to heat alone. This destroys the utility of the phosphor for electrical excitation. Consequently, the phosphor temperature must be limited to below 350° C. For best results, the phosphor temperature should be limited to below 125° C. Consequently, the resistance heating of the phosphor should be limited to a 100° C. rise above an average ambient temperature of about 25° C. Besides the power dissipated in the phosphor in the gap, other factors determine the temperature rise. These factors are, for example, radiant, convective and conductive dissipation of the heat or transfer of the heat to other locations. The prediction of temperature rise and consequently the limits on resistivity, gap size and voltage are well known in the art. The temperature and resistivity characteristics of other phosphors disclosed in the references are well known and the limits on their parameters are established by one skilled in the art without requiring any experimentation.

The cessation of glow in the gap is not instantaneous, but instead tapers off from essentially full glow at the energized segment to an intermediate point in the gap where the illumination becomes insignificant. This gives a desirable shading to the terminator of the glowing line.

The width of gap which may be filled in by the method of the present invention depends on the conductivity of the phosphor material, the segment geometry, the energy of the electric particles exciting the phosphor as well as the magnitudes of the energization and/or deenergization voltages. One skilled in the art could, in light of the teaching of this disclosure, establish the parameters of a fluorescent display device without experimentation.

While any equivalent of a single-pole double-throw switch may be used including mechanical, thermionic valves, or solid state devices, the preferred embodiment employs a complementary metal oxide semiconductor, CMOS, logic switch. The CMOS logic switch is preferred for its low power, high speed and compatability with the input and output voltage levels required in modern display technology. A detailed description of CMOS devices is omitted since their operation is well known to those skilled in the art.

DETAILED DESCRIPTION OF THE PREFERRED EMBODIMENT

Figure 1:
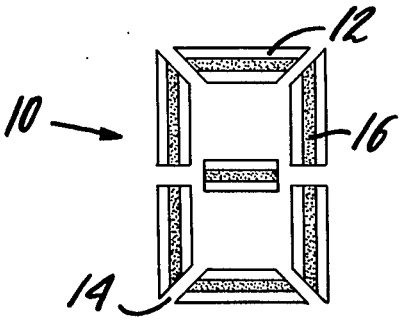
FIG. 1 PRIOR ART
FIG. 1 shows a 7-segment numeric display according to the prior art.

Referring now to FIG. 1, there is shown at 10 a typical 7-segment character of the prior art. Each segment 12 is of highly conducting material such as metal or carbon and is separated from its adjacent segment by a gap 14.

A phosphor area 16 is coated on each segment 12. The phosphor area 16 may cover all or part of its associated segment 12 but does not bridge the gap 14.

Each segment 12 is separately connectable to external energizing circuits to enable the illumination of any combination of segments. By appropriate selection of segment illumination, a stylized representation of any numerical character from 0 to 9 is achievable. In addition to numeric characters any other characters may be created by selection of an appropriate number of properly shaped segments.

Figure 2:
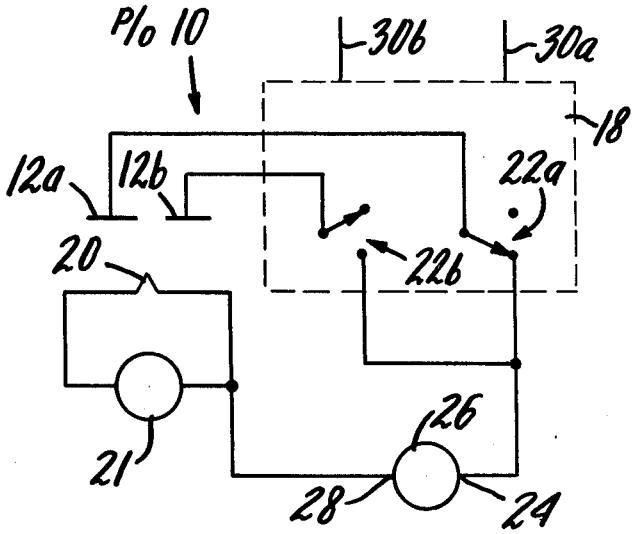
FIG. 2 PRIOR ART
FIG. 2 shows a fractional schematic of a fluorescent display device and an equivalent drive circuit therefor of the prior art.

FIG. 2 shows the equivalent drive circuit 18 for controlling two of the segments **12*a* and 12*b* of a 7-segment character 10 of the vacuum fluorescent type chosen as an example for description only and not for limitation of the scope of the invention. A thermionic filament 20 is heated by an ac or dc power source 21** to a temperature at which electrons are emitted.

The equivalent drive circuit 18 contains the equivalent of single-pole single-throw switches **22*a* and 22*b* connected between the positive terminal 24 of a dc power supply 26 and segments 12*a* and 12*b* respectively. The negative terminal 28 of the dc power supply 26 is connected to the filament 20**.

When equivalent switch **22*a* is in the closed condition shown, the positive voltage connected through it to segment 12*a* accelerates electrons to it from the filament. The electrons impinging on segment 12*a*** causes the phosphor coated on it to glow.

When equivalent switch **22*b* is in the open condition shown, segment 12*b* floats. Since there is no accelerating potential between floating segment 12*b* and the filament 20**, electrons are not accelerated to impinge on it and its phosphor coating remains extinguished.

Equivalent switches **22*a* and 22*b* may be single-pole single-throw mechanical switches but are more typically transistors or integrated circuit devices of the PMOS, NMOS or other types. When electronic switches are used in equivalent drive circuit 18**, the equivalent switches 22*a*, 22*b* are controlled by electrical signals on control lines 30*a* and 30*b* respectively.

Figure 3:
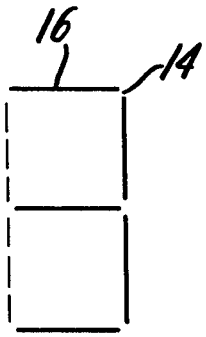
FIG. 3 PRIOR ART
FIG. 3 shows an illuminated display of the prior art.

Referring now to FIG. 3, the visual impression of the glowing phosphor areas 16 shown in solid line energized for a representation of the numeral 3 contains discontinuities at the gaps 14 as explained. Since the prior art equivalent drive circuit 18 in FIG. 2 leaves any deenergized segment floating, these gaps are necessary to prevent conductive bridging by the phosphor from the energized segments to the phosphor on the deenergized segments shown in dashed line.

Figure 4:
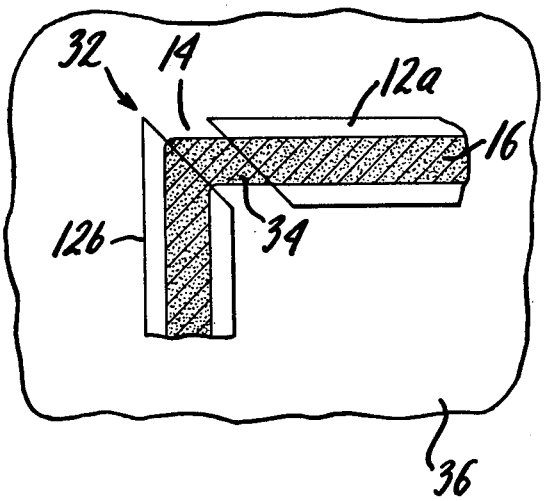
FIG. 4 shows part of a character formed according to the present invention.

Referring now to FIG. 4, one corner of a 7-segment display 32 according to the present invention is shown. The phosphor area 16 is continuous from segment 12*a* to segment 12*b* coating a conductive bridge 34 on the substrate 36 in the gap 14. When segments 12*a* and 12*b* are both energized the entire phosphor area including the conductive bridge 34 is illuminated as indicated by the parallel line hatching.

Figure 5:
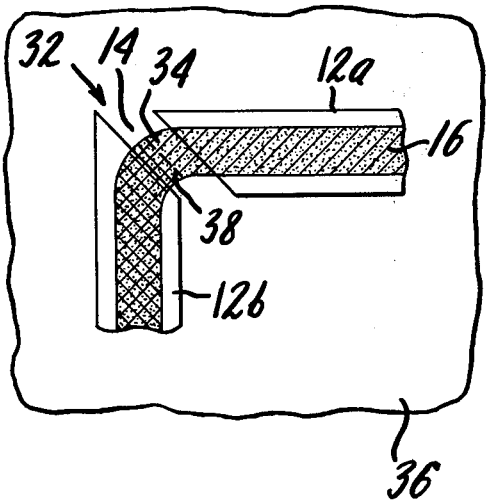
FIG. 5 shows part of a partially illuminated character according to the present invention.

Referring now to FIG. 5, the corner of 7-segment display 32 is shown with segment 12*a* energized as indicated by parallel-line hatching on the phosphor area 16 associated with it, and with segment 12*b* deenergized as indicated by the cross hatching on it. In the gap 14 the conductive bridge 34 is illuminated near energized segment 12*a* and becomes progressively dimmer toward deenergized segment 12*b* until its illumination becomes negligible at a terminator 38 shown in dashed line. The terminator may be nearer segment 12*a* or 12*b* depending upon the voltages employed for energization and deenergization and for bias on other elements in the device.

Figure 6:
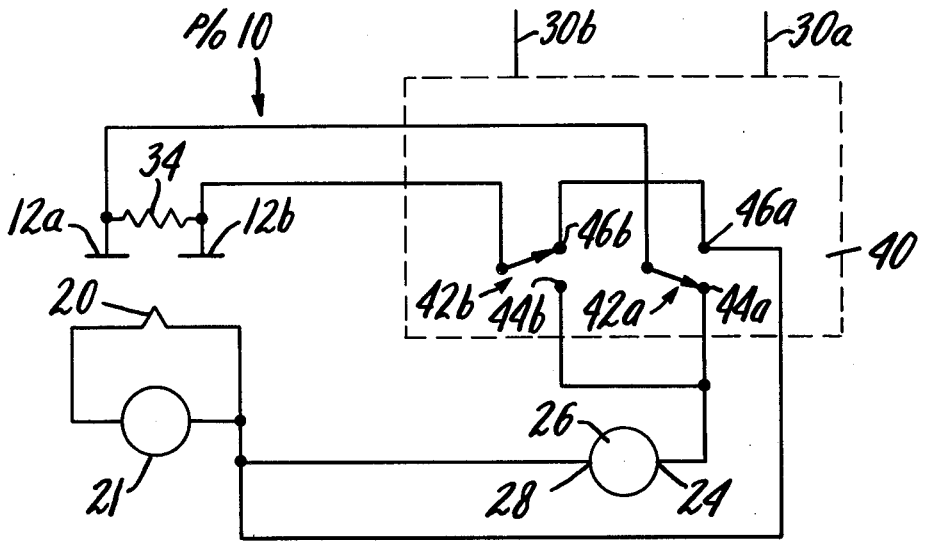
FIG. 6 shows a schematic diagram of a portion of a display device and the drive circuits therefor according to the present invention.

Referring now to FIG. 6, there is shown two segments 12*a* and 12*b* each being controlled by an equivalent drive circuit 40 containing one equivalent single-pole double-throw switch 42*a* and 42*b* for each controlled segment 12*a* and 12*b* respectively. The equivalent switches 42*a* and 42*b* have front contacts 44*a* and 44*b* connected to the positive terminal 24 of dc power supply 26 and back contacts 46*a* and 46*b* respectively connected to the negative terminal 28 of dc power supply 26.

When equivalent switch 42*a* is in the closed condition shown, positive accelerating voltage is applied between the filament 20 and segment 12*a* thus illuminating the phosphor associated with it. When equivalent switch 42*b* is in the open condition shown, its back contact 46*b* connects the negative extinguishing voltage to segment 12*b*. The conductive bridge 34, indicated by the resistor symbol has a resistance high enough to limit the current between segments 12*a* and 12*b* adequately to prevent overloading the current supply capabilities of the dc power supply 26.

Although equivalent switches 42*a* and 42*b* may be any mechanical, electronic or equivalent single-pole double-throw switch, the preferred embodiment employs CMOS integrated circuit switches.

Figure 7:
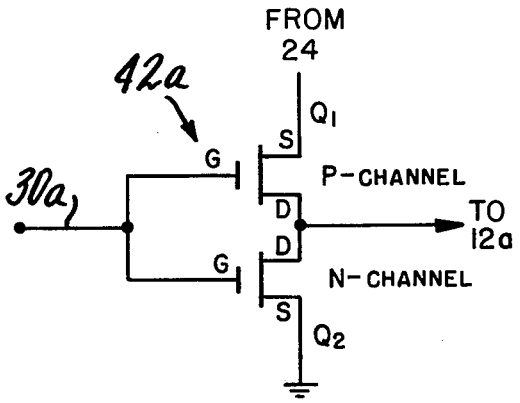
FIG. 7 shows a CMOS logic switch.

A typical CMOS switch is shown in FIG. 7. A P-channel transistor Q1 is connected in series with an N-channel transistor Q2 between the positive terminal 24 of the dc power supply 26 and ground. The control line 30*a* varies from about 0 volts to about a voltage equal to the positive voltage from terminal 24. When the control signal on control line 30*a* is low or near ground, the gate to source threshold level for Q2 is less than that required for conduction. Therefore Q2 is cut off. However, with the input low, the gate to source voltage threshold of Q1 is exceeded. Since the gate is more negative than the source, this P-channel device conducts and connects the supply voltage from positive terminal 24 to segment 12*a*. This causes segment 12*a* to become illuminated.

When the voltage on control line 30*a* goes high, the gate to source threshold voltage of transistor Q2 is exceeded. Transistor Q2 now conducts and acts as a very low resistance thereby placing a ground on segment 12*a*. At the same time, the positive voltage on control line 30*a* causes the gate to source potential on transistor Q1 to fall below the threshold required for conduction of transistor Q1. Consequently transistor Q1 is cut off.

The CMOS integrated circuit switch provides very low resistance between the positive supply and segment 12*a* when it is in the on condition and provides very low resistance between ground and the segment 12*a* when it is in the off condition. Consequently, the CMOS integrated circuit switch provides the function of the equivalent single-pole double-throw switch 42*a* described in connection with equivalent drive circuit 40 in FIG. 6.

Figure 8:
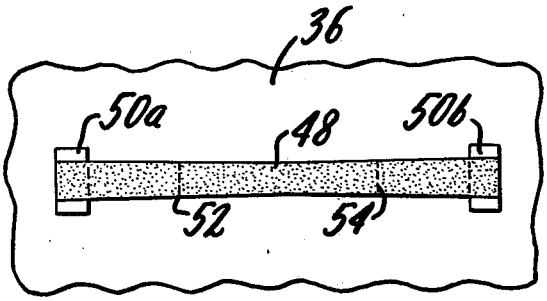
FIG. 8 shows a proportionately illuminated fluorescent display according to a second embodiment of the invention.

Although the preceding has dealt with display devices and their control in which a first voltage causes the illumination of a segment and a second voltage causes the extinguishment of the segment, the present invention also contemplates the proportionate control of a fluorescent indicator device. As shown in FIG. 8, an extended phosphor line 48 is coated on a substrate 36 and overlaps conductive terminals 50*a* and 50*b* at the ends thereof. By controlling the relationship between the voltages applied to terminals 50*a* and 50*b* as well as controlling these voltages with respect to the voltages on other elements in the device, the portion of the phosphor line 48 which is illuminated can be controlled. For example, in a vacuum fluorescent device, if terminal 50*b* is made very strongly positive and terminal 50*a* is maintained at zero, a large fraction of the length of the phosphor line 48 will be illuminated. For example, with one choice of voltages, the terminator or the glowing line may be at 52 which is significantly closer to terminal 50*a* than to 50*b*. Conversely, if terminal 50*b* is less strongly positive than in the previous example or if terminal 50*a* is made strongly negative, the terminator may be moved to location 54 on the phosphor line much closer to terminal 50*b*. Thus, control of the voltages permits analog illumination of a line length in proportion to the voltages used. The length of the phosphor line 48 is limited by the conductivity of the phosphor material used and the size and voltage constraints of practical fluorescent display devices.

Figure 9:
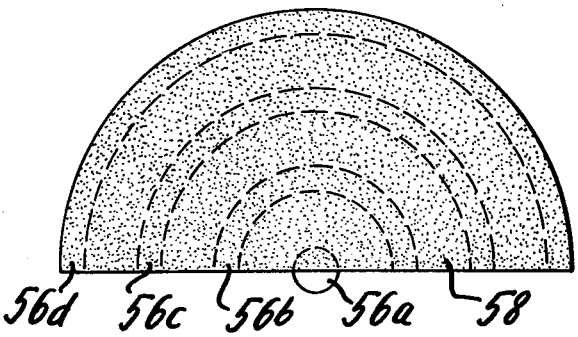
FIG. 9 shows another type of proportionately illuminated display.

Besides straight lines of phosphor such as illustrated by phosphor line 48, other patterns are foreseen. For example, a dynamic sunburst display may be formed as shown in FIG. 9. Center terminal 56*a* and concentric arc-shaped terminals 56*b*, 56*c* and 56*d* may be laid down on an insulating substrate. By controlling the voltage relationship of the terminals 56*a–d*, the phosphor-coated region between any pair of terminals, such as the region 58 between terminals 56*b* and 56*c*, can be illuminated in whole or in part. By dynamically controlling the voltages on all terminals 56*a–d*, it is possible to control a sweeping illumination of the entire semicircular display from the vicinity of the center terminal 56*a* out to the outer terminal 56*d* in a continuous growing illumination. The regions 58 may also be illuminated in steps in any order by control of the terminals 56*a–d* in a manner previously described.

In the proportional control fluorescent display devices described in preceding paragraphs, advantage has been taken of the fact that the application of a voltage between spacedapart points in a phosphor coating provides a field of voltage varying along the phosphor between the contacts. The excitation of the phosphor is proportional to the magnitude of the voltage at a point and this voltage is controlled by the spaced-apart terminals. Other ways of controlling voltages in a field are also possible. For example, the substrate may be coated with a resistive medium, such as iron oxide or the like, having in electrical contact therewith two or more electric contacts. By applying voltages to the electrodes, varying electric potentials are set up in the resistive medium. A phosphor coating on the resistive medium will be influenced by the voltages set up in the resistive medium to fluoresce in proportion to the voltage existing at each point. In this application, control of the voltage is preferably in the resistive medium rather than in the phosphor. This may be accomplished by using a relatively low resistive medium combined with a relatively high resistance phosphor or by dividing the phosphor into discrete islands to avoid distribution of the voltage by the phosphor in preference to its distribution by the resistive medium.

It will be understood that the claims are intended to cover all changes and modifications of the preferred embodiments to the invention, herein chosen for the purpose of illustration which do not constitute departures from the spirit and scope of the invention.

What is claimed is:

1. A fluorescent display device comprising an insulating substrate, at least two spaced apart electrodes on said substrate, said at least two electrodes being electrical conductors and a phosphor area in electrical contact with said at least two electrodes, said phosphor area coating at least part of said substrate in a continuous area between said at least two electrodes and forming a resistive bridge therebetween the coating in said continuous area being conductive and having a substantially higher resistance than said at least two electrodes.

2. The fluorescent display device recited in claim 1 wherein the phosphor is said phosphor area in ZnO:Zn.

3. the fluorescent display device recited in claim 1 further comprising a drive circuit for said fluorescent display device having:

(a) an independent equivalent single-pole double throw switch having first and second conditions between each of said at least two electrodes and a first voltage source when in its first condition and a second voltage source when in its second condition; and (b) said first voltage source being operative to excite at least part of said phosphor area into fluorescence.

4. The fluorescent display device recited in claim 3 wherein said independent equivalent single-pole double-throw switches are complementary metal oxide semiconductor logic switches.

5. The fluorescent display device recited in claim 1 wherein said fluorescent display device is a vacuum fluorescent display having:

(a) a thermionic filament; and (b) at least two of said electrodes being anodes.

6. The fluorescent display device recited in claim 5 wherein at least part of said anodes is coated with said phosphor and the phosphor coated on said anodes is in contact with said resistive bridge.

7. A fluorescent display system comprising:

(a) a fluorescent display device having:

i. an insulating substrate;

ii. at least two conductive electrodes on said insulating substrate;

iii. a transparent cover sealed over said substrate and said at least two conductive electrodes;

iv. a resistive bridge on said substrate between said at least two conductive electrodes;

v. a resistive phosphor area at least on said resistive bridge; and vi. at least one other type of electrode; and (b) a drive circuit having:

i. an equivalent single-pole double-throw switch having first and second conditions between each of said at least two conductive electrodes and first and second voltages;

ii. each of said single-pole double-throw switches connecting its conductive electrode to said first voltage when in its first condition and to said second voltage when in its second condition;

iii. said first voltage being operative to excite at least an area of said phosphor near the electrode connected to it into fluorescence;

iv. said second voltage being operative to extinguish fluorescence in at least an area of phosphor near it; and v. said first and second electrodes, said resistive bridge and said phosphor in combination being operative to excite substantially all of the phosphor in electrical contact with said resistive bridge into fluorescence when the equivalent single-pole double-throw switches associated said first and second electrodes are both in their first condition.

8. The fluorescent display device recited in claim 7 wherein said equivalent single-pole double-throw switches are complementary metal oxide semiconductor logic switches.

9. The fluorescent display device recited in claim 7 wherein:

(a) said fluorescent display device is a vacuum fluorescent display;

(b) said at least one other type of electrode is a thermionic filament; and (c) said first and second conductive electrodes are anodes.

10. The fluorescent display device recited in claim 7 wherein:

(a) said fluorescent display device is a gas discharge device;

(b) said at least two conductive electrodes are cathodes;

(c) said second voltage source being operative to extinguish fluorescence in at least part of said phosphor; and (d) said first and second electrodes and said resistive bridge in combination being operative to excite substantially all of the phosphor in said resistive bridge between said first and second electrodes into fluorescence when said independent equivalent single-pole double-throw switches connected to said first and second electrodes are both in their first conditions.

11. A fluorescent display device comprising:

(a) an insulating substrate;

(b) a plurality of contact means on said substrate;

(c) resistive phosphor on said substrate bridging at least two of said plurality of contact means;

(d) drive means for independently controlling voltage applied to said at least two contact means; and (e) said drive means in combination with said phosphor and said at least two contact means being effective to excite a selectable portion of said phosphor into fluorescence.

12. The fluorescent display device recited in claim 11 further comprising said voltage applied to said at least two contact means having two values.

13. The fluorescent display device recited in claim 11 further comprising said voltage applied to said at least two contact means having more than two values.

14. The fluorescent display device recited in claim 11 further comprising said voltage having a continuous range of values between a minimum and a maximum.

15. The fluorescent display device recited in claim 14 further comprising said drive means being operative for illuminating an area of phosphor near a first of said two contact means and extinguishing an area of phosphor near the second of said two contact means, the illuminated and extinguished areas being contiguous at a terminator and said drive means being further operative for displacing said terminator toward either said first or second of said two contact means.

16. A fluorescent display device comprising a plurality of spaced apart phosphor-coated electrode means:

(a) means for selectably illuminating said phosphor-coated electrode means to indicate at least one changeable indicium;

(b) means for illumination of the space between contiguous illuminated electrode means whereby an unbroken illuminated area bridging said contiguous illuminated electrode means is formed;

(c) means for selectively extinguishing said phosphor-coated electrode means; and (d) means for extinguishing the space between contiguous extinguished electrode means.

17. The fluorescent display device recited in claim 2 wherein said at least two spaced apart electrodes are at least partly carbon.

18. The fluorescent display device recited in claim 1 further comprising said phosphor area having an area resistivity at least 10 times the area resistivity of said at least two electrodes.

19. The fluorescent display device recited in claim 1 further comprising said phosphor area having an area resistivity at least 100 times the area resisitivity of said at least two electrodes.

20. The fluorescent display device recited in claim 3 further comprising the temperature rise in said resistive bridge being less than 100° C.

21. The fluorescent display device recited in claim 3 further comprising the temperature of said resistive bridge being less than 350° C.

22. The fluorescent display device recited in claim 1 wherein the phosphor in said phosphor area in SnO:Eu.

* * * * *